US005408724A

United States Patent [19]

Mullet et al.

[11] Patent Number: 5,408,724

[45] Date of Patent: Apr. 25, 1995

[54] JAMB BRACKET AND TRACK ASSEMBLY FOR SECTIONAL OVERHEAD DOORS

[75] Inventors: Willis Mullet, Pensacola Beach, Fla.; Thomas B. Bennett, III, Wooster, Ohio

[73] Assignee: Wayne-Dalton Corporation, Mt. Hope, Ohio

[21] Appl. No.: 56,991

[22] Filed: May 3, 1993

[51] Int. Cl.[6] ..... E05D 15/00

[52] U.S. Cl. ..... 16/94 R

[58] Field of Search ..... 16/94 R, 94 D, 87.6 R, 16/87.2, 90

[56] References Cited

U.S. PATENT DOCUMENTS

| | | | |
|---|---|---|---|
| 1,131,399 | 3/1915 | McGinley . | |
| 1,247,938 | 11/1917 | Curtenius . | |
| 2,686,926 | 8/1954 | Schacht, Jr. et al. | 16/94 |
| 2,991,496 | 7/1961 | Wolf et al. | 16/94 |
| 3,009,719 | 11/1961 | Otto et al. . | |
| 3,129,751 | 4/1964 | Weber | 16/94 D |
| 3,156,282 | 11/1964 | Bedford, Jr. . | |
| 4,133,560 | 1/1979 | Ishikawa et al. . | |
| 4,382,710 | 5/1983 | Slowbe . | |
| 4,536,936 | 9/1985 | Zeidl . | |

FOREIGN PATENT DOCUMENTS

| | | | |
|---|---|---|---|
| 8809303 | 5/1989 | Germany | E06B 1/60 |
| 713906 | 9/1966 | Italy | 16/94 R |

*Primary Examiner*—P. Austin Bradley
*Assistant Examiner*—Chuck Y. Mah
*Attorney, Agent, or Firm*—Renner, Kenner, Greive, Bobak, Taylor & Weber

[57] ABSTRACT

A jamb bracket (10, 40) and track (30, 60) assembly for the support of overhead sectional doors and the like. The assembly comprises bracket means (10,40) having tab means (20,50) and track means (30,60) having tab slots (34,74). The tab means (20,40) engage the tab slots (34,74) for attachment of the bracket means (10,40) to the track means (30,60). A related jamb bracket (10,40) comprises a U-shaped main body (14,44), providing first and second perpendicularly disposed legs (16,46 and 18,48) and, tab means (30,60) offset from the main body (14,44).

11 Claims, 4 Drawing Sheets

JAMB BRACKET AND TRACK ASSEMBLY FOR SECTIONAL OVERHEAD DOORS

TECHNICAL FIELD

The present invention is directed toward jamb brackets and track assemblies for sectional overhead doors and the like. Each jamb bracket engages the track member and is in turn attached to the door jamb. The jamb bracket holds the track in a fixed position relative to the door so that the door may roll freely in the track. Such assemblies are typically used in conjunction with overhead sectional garage doors in both residential and commercial settings.

BACKGROUND ART

Typically, jamb brackets are manufactured in a single piece from heavy angle iron or from stamped angles and fiat stock, which must be fastened together with screws or rivets. Heavy material thicknesses are required with such brackets to provide the necessary strength. Attachment of the track to the jamb bracket has previously been accomplished by fiat or round head bolts and nuts. Such bolts must be adjusted precisely in order to ensure adequate clearance for the door rollers in the track.

Despite the years that jamb brackets and track assemblies have been employed and the various design variations, assembly and installation time as well as manufacturing costs can be significant. Installation and assembly involving numerous elements and fasteners is tedious and requires multiple adjustments to ensure smooth operation of the door.

DISCLOSURE OF THE INVENTION

It is therefore an object of the present invention to provide a jamb bracket whereby a track member can be mounted to a door jamb.

It is another object of the present invention to provide a jamb bracket and track member which can be manufactured from thin gauge material, yet still provide adequate strength.

It is yet another object of the present invention to provide a jamb bracket and track member which can be easily connected without the need for tools or separate fasteners.

It is still another object of the present invention to provide a jamb bracket and track member which can be inexpensively manufactured using commonly available materials and conventional manufacturing techniques.

At least one or more of the foregoing objects, together with the advantages thereof over known jamb brackets and track assemblies, which shall become apparent from the specification which follows, are accomplished by the invention as hereinafter described and claimed.

In general, a jamb bracket and track assembly for the support of sectional overhead doors and the like comprises bracket means having tab means and track means having tab slots, the tab means being engagable with the tab slots for attachment of the bracket means to the track means.

The present invention also provides a related jamb bracket for the support of overhead sectional doors and the like comprising a U-shaped main body member, providing first and second perpendicularly disposed legs and, tab means offset from the body means.

PREFERRED EMBODIMENT FOR CARRYING OUT THE INVENTION

Figure 1:
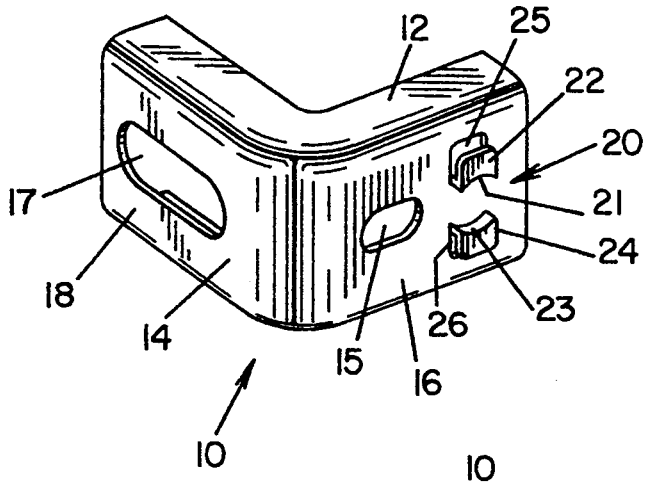
FIG. 1 is a perspective view of a jamb bracket according to the present invention.

A representative embodiment of a jamb bracket according to the concept of the present invention is generally referred to by the numeral 10 in the accompanying drawings. The jamb bracket 10 is manufactured from a thin gauge metal, preferably a galvanized steel in the range of 16 gauge to 20 gauge. The use of such thin gauge material is facilitated by the U-shaped cross section of jamb bracket 10. This U-shaped cross section is defined by an inturned flange 12 and a body 14. Flanges 12 are inturned 90 degrees relative to body 14 and are in the range of 6 to 20 material thicknesses high. Such a configuration provides strength and rigidity without the need for thicker, more heavy materials.

Figure 2:
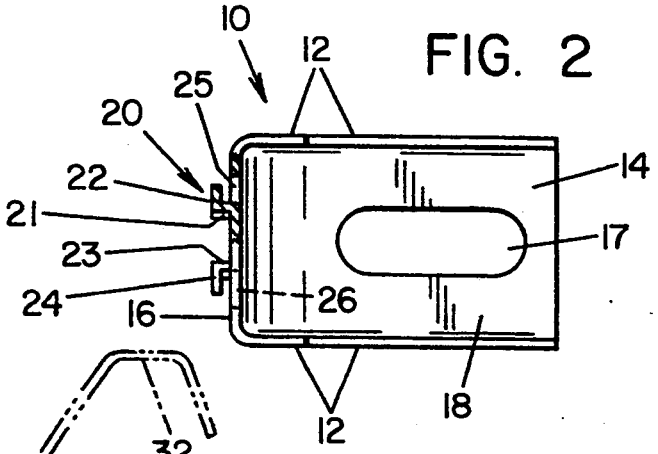
FIG. 2 is a rear view, partially in section, of the jamb bracket.
Figure 3:
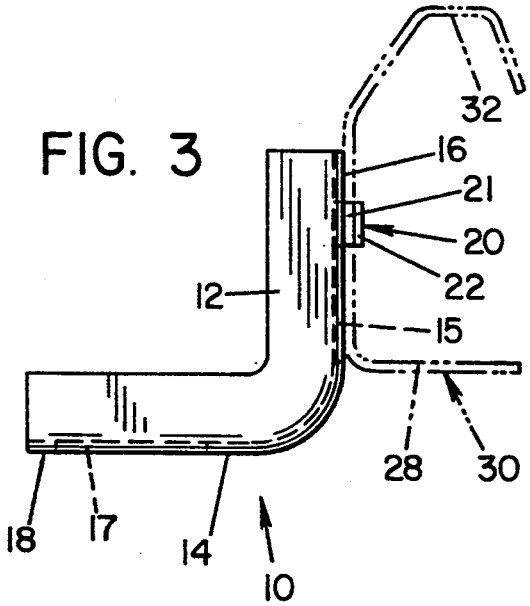
FIG. 3 is a top plan view of the jamb bracket, depicting a track member in phantom.
Figure 4:
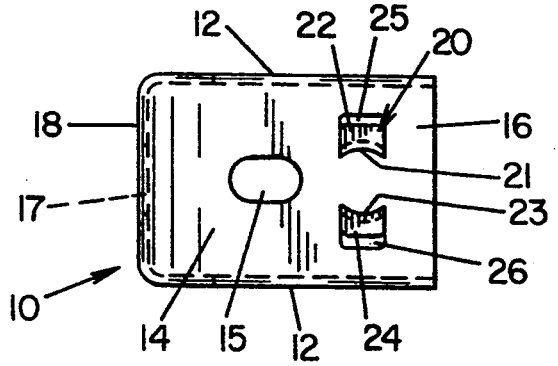
FIG. 4 is a side elevation of the jamb bracket.

With reference to FIGS. 1 and 2 it can be seen that jamb bracket 10 is bent at a fight angle thereby defining a first leg 16 and a second leg 18. First leg 16 and second leg 18 are each provided with oblong apertures 15 and 17, respectively, for reasons which will become apparent as the description continues. First leg 16 is also provided with tab means, indicated generally by the numeral 20. Tab means 20 includes an arcuate first arm 21 and an ear 22. The arcuate first arm 21 extends perpendicularly from the body 14 and ear 22 extends perpendicularly therefrom and parallel to body 14. Tab means 20 also provides an arcuate second arm 23 and an ear 24. The arcuate second arm 23 extends perpendicularly from the body 14 and ear 24 extends perpendicularly therefrom and parallel to body 14. For reasons which will become apparent, ears 22 and 24 are offset from body 14 by a distance approximating the material thickness of the track member. Tab means 20 is positioned such that the arcuate first arms 21 and 23 face one another and form the partial circumference of a circle.

Tab means 20 is formed in a conventional manner, such as by stamping the arms 21 and 23 from first leg 16, leaving a pair of apertures 25, and then bending the ears 22 and 24 away from each other and perpendicular to arms 21 and 23, respectively.

Figure 5:
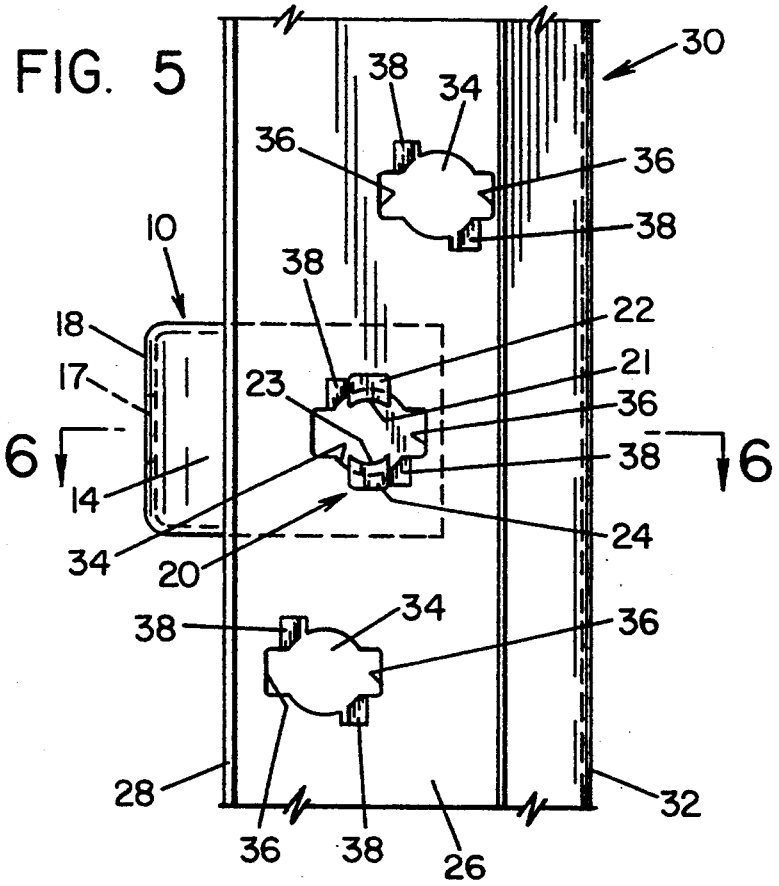
FIG. 5 is a side view of a track member according to the present invention with an attached jamb bracket.
Figure 6:
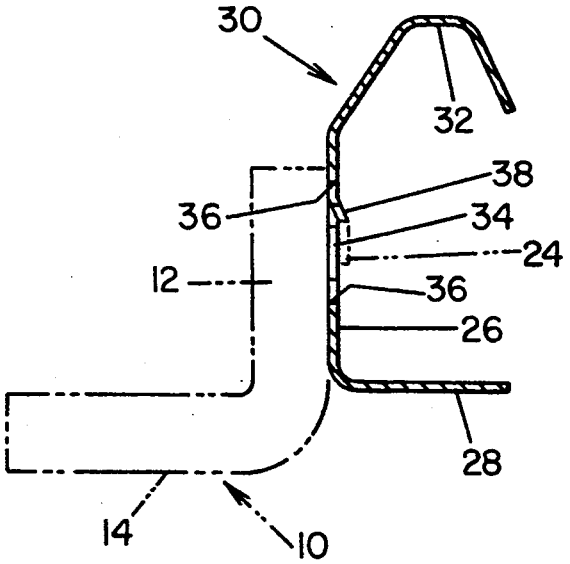
FIG. 6 is a sectional view of the track member, taken substantially on line 6—6 of FIG. 5.

With reference now to FIGS. 5 and 6, a representative embodiment of a track member according to the concept of the present invention is referred to generally by the numeral 30. Track member 30 is manufactured from any appropriate material, preferably a galvanized steel in the range of 16 gauge to 18 gauge in thickness, and is of a conventional C-shaped cross section to accommodate the conventional door rollers (not shown). The C-shaped cross section is defined by a main body 26, a flange 28 and a roller race 32. A number of tab slots 34 are included in groups, preferably of three or more at various locations along the length of the main body 26. As shown in FIG. 5, tab slots 34 are both horizontally and vertically offset from adjacent tab slots 34. Tab slots 34 are primarily circular in shape with the circumference being interrupted by a pair of rectangular notches 36. The notches 36 are diametrically opposed from one another and are perpendicular to the length of the track member 30. The circumference of tab slot 34 is further interrupted by a pair of flared stops 38. Flared stops 38 are formed by a stamping process whereby the material is flared inwardly at points opposite one another on the circumference of tab slot 34 and adjacent to respective rectangular notches 36.

Assembly of the present invention is accomplished first by fastening together the required track members 30. The number of track members 30 which are required for a particular installation is dictated primarily by the size of the door to be installed. Jamb bracket 10 may then be mounted to track member 30. Mounting is accomplished by first aligning ears 22 and 24 of tabs 20 on the jamb bracket 10 with the rectangular notches 36 of tab slots 34 on the track member 30. Once such alignment is accomplished, tabs 20 of jamb bracket 10 may be inserted into tab slots 34 of track member 30. Jamb bracket 10 is then rotated counter-clockwise 90 degrees relative to track member 30 at which point tabs 20 will engage flared stops 38, thereby preventing further clockwise rotation. Simultaneously, the arcuate surfaces of first arms 21 and 23 of tab means 20 on the jamb bracket 10 frictionally engage the inner diameter of the tab slots 34 of the track member 30.

As discussed previously, ears 22 and 24 of tab means 20 are offset from the body 14 of jamb bracket 10 by a distance corresponding to the material thickness of track member 30, as such, first and second ears 22 and 24 frictionally engage the inner surface of track member 30. Thus, the jamb bracket 10 is held in locking engagement with track member 30 until sufficient torque is applied in a clockwise direction to overcome the frictional engagement, and tab means 20 clears tab slots 34.

Once jamb bracket 10 has been assembled to track member 30, the assembly may be mounted to the door jamb. Attachment of the jamb bracket 10 to the door jamb is accomplished by utilizing first oblong aperture 17 which receives a conventional fastener such as a lag screw. The lag screw is, in turn, fastened to the door jamb. First oblong aperture 17 allows for adjustment of the jamb bracket 10 and track member 30 relative to the door jamb. Further adjustment of the assembly may be accomplished by moving jamb bracket 10 from one tab slot 34 to another horizontally and vertically offset tab slot 34, the tab slots 34 being provided at numerous locations on track member 30. The second oblong aperture 15 is provided on the first leg 16 of jamb bracket 10 so that a track member may be attached to jamb bracket 10 by conventional means such as fiat or round head bolts. The latter is desirable where the jamb bracket is to be used with a conventional track member. In such an instance, tabs 20 may be flattened or removed so as not to interfere with attachment of the jamb bracket 10 to the track member.

A representative embodiment of an alternative embodiment of jamb bracket according to the concept of the present invention is generally referred to by the numeral 40 in the accompanying drawings. The jamb bracket 40 is manufactured from a thin gauge metal, preferably a galvanized steel in the range of 16 gauge to 20 gauge. The use of such thin gauge material is facilitated by the U-shaped cross section of jamb bracket 40. This U-shaped cross section is defined by an inturned flange 42 and a body 44. Flanges 42 are inturned 90 degrees relative to body 44 and are in the range of 6 to 20 material thicknesses high. Such a configuration provides strength and rigidity without the need for thicker, more heavy materials.

Figure 7:
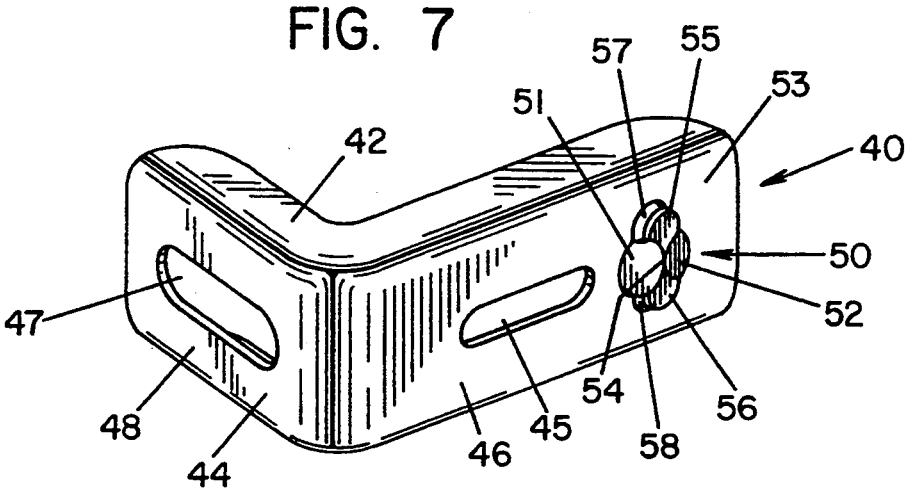
FIG. 7 is a perspective view of an alternate embodiment of jamb bracket according to the present invention.
Figure 8:
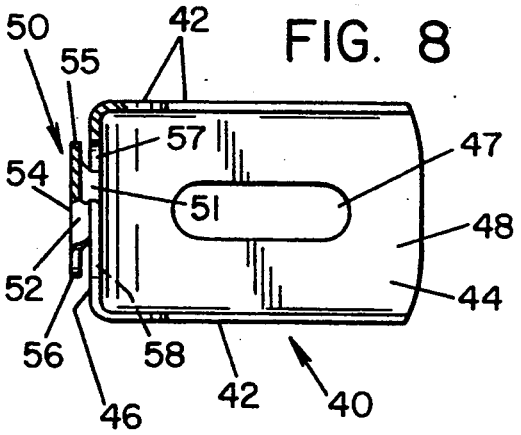
FIG. 8 is a rear view, partially in section, of the jamb bracket of FIG. 7.
Figure 9:
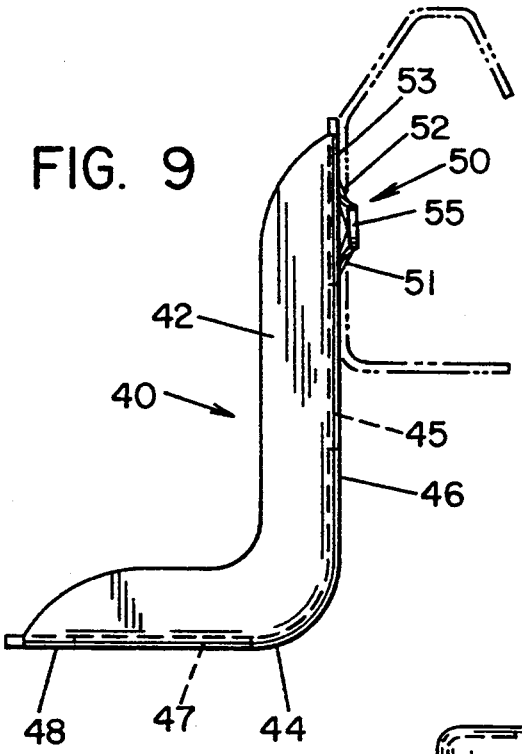
FIG. 9 is a top plan view of the jamb bracket of FIG. 7, depicting a track member in phantom.
Figure 10:
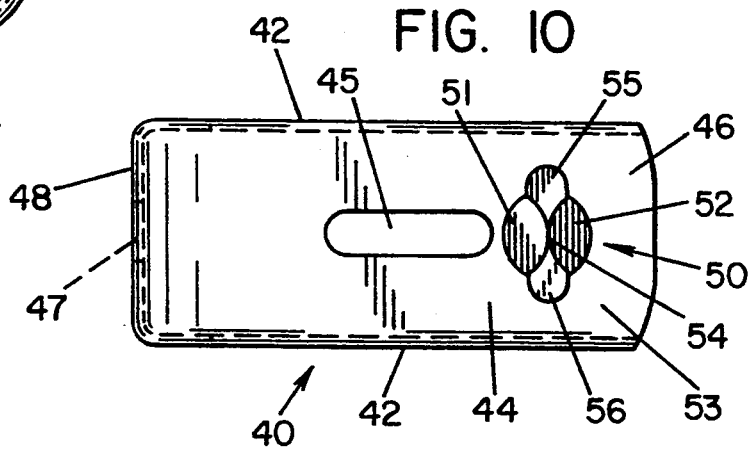
FIG. 10 is a side elevation of the jamb bracket of FIG. 7.

With reference to FIGS. 7 and 8 it can be seen that jamb bracket 40 is bent at a fight angle thereby defining a first leg 46 and a second leg 48. First leg 46 and second leg 48 are each provided with oblong apertures 45 and 47, respectively. First leg 46 is also provided with tab means, indicated generally by the numeral 50. Tab means 50 includes a pair of arms 51 and 52 which are stamped outwardly from the face 53 of first leg 46 and are joined together in a saddle 54. Extending outwardly at generally 90 degree angles from arms 51 and 52 and saddle 54 are a pair of ears, 55 and 56, respectively. As is apparent from FIGS. 7 and 10, the ears 55 and 56 have a north and south orientation while the arms 51 and 52 are oriented to the west and east, respectively. Apertures 57 and 58 are formed in first leg 46 when the ears 55 and 56 are stamped. Although the ears 55 and 56 appear flat, it is to be understood that they could be further formed to bend downwardly or upwardly with respect to face 53 and, that they could also be curved along the north-south axis to provide a concave face toward face 53. For reasons which will again become apparent, ears 55 and 56 are offset from body 44 by a distance approximating the material thickness of the track member.

Figure 11:
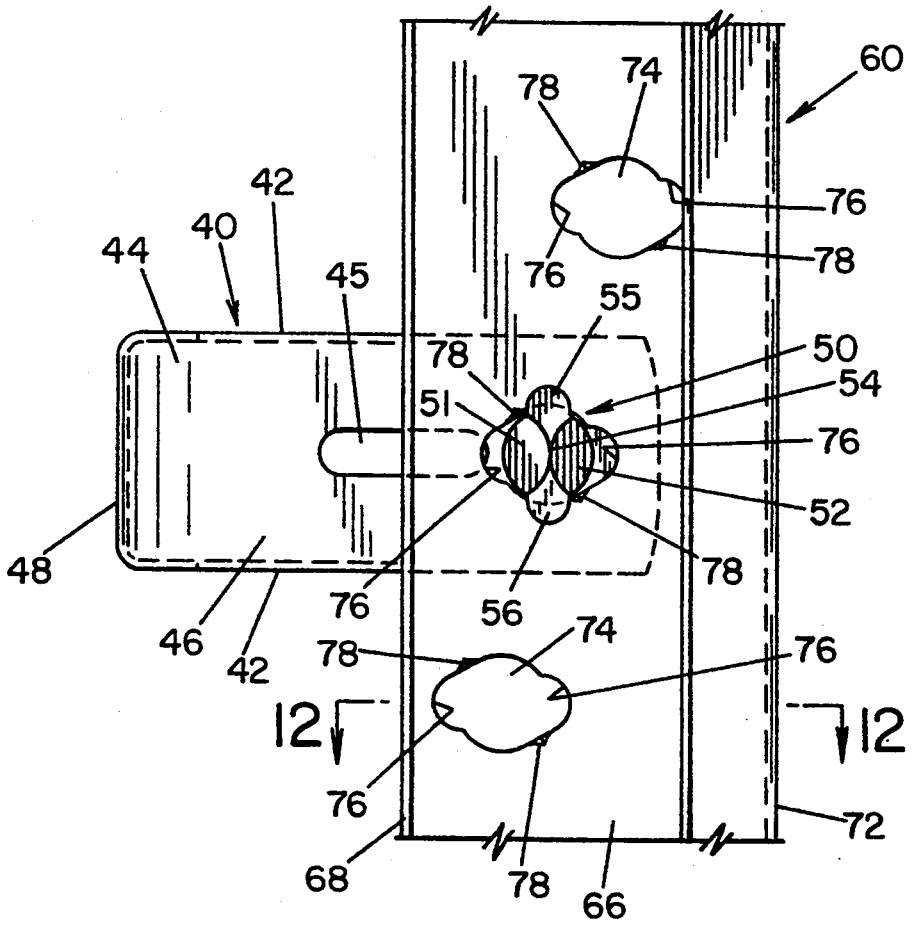
FIG. 11 is a side view of a track member according to the present invention with an attached jamb bracket of FIG. 7.
Figure 12:
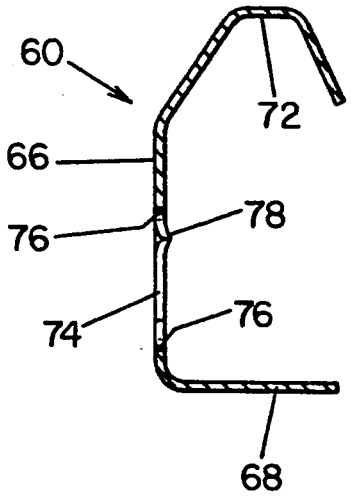
FIG. 12, is a sectional view of the track member, taken substantially on line 12—12 of FIG. 11.

With reference now to FIGS. 11 and 12, a representative embodiment of a track member according to the concept of the present invention is referred to generally by the numeral 60. Track member 60 is manufactured from any appropriate material, preferably a galvanized steel in the range of 16 gauge to 18 gauge in thickness, and is of a conventional C-shaped cross section to accommodate the conventional door rollers (not shown). The C-shaped cross section is defined by a main body 66, a flange 68 and a roller race 72. A number of tab slots 74 are included in the main body 66. Tab slots 74 are primarily circular in shape with the circumference being interrupted along the east-west axis by a pair of semi-circles 76. The semi-circles 76 are diametrically opposed from one another and are perpendicular to the length of the track member 60. The circumference of tab slot 74 is further interrupted by a pair of flared stops 78, which are formed at the intersection of tab slot circumference and the semi-circles 76 by a stamping process whereby the material is flared inwardly at points opposite one another on the circumference of tab slot 74.

Assembly of the present invention is accomplished first by fastening together the required track members 60. The number of track members 60 which are required for a particular installation is again dictated primarily by the size of the door to be installed. Jamb bracket 40 may then be mounted to track member 60. Mounting is accomplished by first aligning ears 55 and 56 of tabs means 50 on the jamb bracket 40 with the semi-circles 76 of tab slots 74 on the track member 60. Once such alignment is accomplished, the ears 55 and 56 are inserted into tab slots 74 of track member 60. Jamb bracket 40 is then rotated counter-clockwise 90 degrees relative to track member 60 at which point ears 55 and 56 will engage flared stops 78, thereby preventing further clockwise rotation. Simultaneously, the raised circumferential regions of arms 51 and 52 frictionally engage the inner diameter of the tab slots 74. As discussed previously, the ears 55 and 56 of tab means 50 on the jamb bracket 40 are offset from the body 44 of jamb bracket 40 by a distance corresponding to the material thickness of track member 60. Thus, the jamb bracket 40 is held in locking engagement with track member 60 until sufficient torque is applied in a clockwise direction to overcome the frictional engagement, and tab means 50 clear tab slots 74.

Once jamb bracket 40 has been assembled to track member 60, the assembly may be mounted to the door jamb. Attachment of the jamb bracket 40 to the door jamb is accomplished by utilizing oblong aperture 47 which receives a conventional fastener such as a lag screw. The lag screw is, in turn, fastened to the door jamb. The oblong aperture 47 allows for adjustment of the jamb bracket 40 and track member 60 relative to the door jamb. Further adjustment of the assembly may be accomplished by moving jamb bracket 40 from one tab slot 74 to another, the tab slots 74 being provided at several locations on track member 60. The second oblong aperture 45 is provided on the first leg 46 of jamb bracket 40 so that a track member may be attached to jamb bracket 40 by conventional means such as flat or round head bolts. The latter is desirable where the jamb bracket is to be used with a conventional track member. In such an instance, tab means 50 may be flattened or removed so as not to interfere with attachment of the jamb bracket 10 to the track member.

Thus it should be clear, to those skilled in the art, the manner in which the jamb bracket and track assembly described herein is constructed, assembled and used. It should also be clear that the jamb brackets 10 and 40 are novel and may be utilized with the track member 30 and 60, respectively, of this invention as well as existing track members.

Based upon the foregoing disclosure, it should now be apparent that the use of the assembly described herein will carry out the objects set forth hereinabove. It should also be apparent to those skilled in the art that the jamb bracket and track assembly can be utilized in conjunction with various types of overhead sectional doors.

Although approximate thicknesses have been disclosed for the materials, none of the ranges should be interpreted as limiting. It is believed that those skilled in the art can determine the materials and sizes that will be most useable from the total specification disclosure provided herein.

It is, therefore, to be understood that any variations evident fall within the scope of the claimed invention and thus, the selection of specific component elements can be determined without departing from the spirit of the invention herein disclosed and described. Moreover, the scope of the invention shall include all modifications and variations that may fall within the scope of the attached claims.

What is claimed is:

1. A jamb bracket and track assembly for the support of sectional overhead doors comprising:

bracket means having at least one tab means extending therefrom, said tab means including first and second arms and ears extending perpendicularly from each of said first and second arms; and track means having at least one tab slot, said tab slot being generally circular and interrupted by rectangular notches and flared stops and being engagable with said tab means for attachment of said bracket means to said track means.

2. A jamb bracket and track assembly, as set forth in claim 1, wherein said tab means is insertable into said at least one tab slot and said bracket means is rotatable with respect to said track means.

3. A jamb bracket and track assembly, as set forth in claim 1, wherein said ears frictionally engage said track member and said first and second arms frictionally engage said at least one tab slot.

4. A jamb bracket and track assembly, as set forth in claim 1, wherein said ears engage said flared stop.

5. A jamb bracket and track assembly for the support of sectional overhead doors comprising:

bracket means having at least one tab means extending therefrom, said tab means including first and second arms and ears extending perpendicularly from each of said first and second arms; and track means having at least one tab slot, said tab slot being generally circular and interrupted by opposed semicircles and flared stops and being engageable with said tab means for attachment of said bracket means to said track means.

6. A jamb bracket and track assembly, as set forth in claim 5, wherein said first and second arms are joined along a common edge to form a saddle.

7. A jamb bracket comprising:

main body means having a U-shaped cross-section providing first and second perpendicularly disposed legs; and at least one tab means offset from said main body means, said tab means having first and second arms extending from said main body means, and ears extending perpendicularly from each of said first and second arms and parallel to one of said legs of said main body means, said body and said tab means thereby forming a one piece bracket.

8. A jamb bracket and track assembly, as set forth in claim 7, wherein said first and second arms are arcuate.

9. A jamb bracket, as set forth in claim 7, wherein said first and second legs include oblong apertures.

10. A jamb bracket, as set forth in claim 7, wherein said first and second arms are joined along a common edge to form a saddle.

11. A jamb bracket and track assembly for the support of sectional overhead doors comprising:

at least two track means for mounting sectional overhead doors;

a plurality of bracket means for positioning said track means with respect to a wall and having at least one tab means;

said track means having a plurality of tab slots provided at various locations along the length thereof, said tab slots being offset both vertically and horizontally from adjacent tab slots;

said tab means being engagable with one said tab slot for attachment of said bracket means to said track means, whereby said tab means of successive bracket means can be engaged with a different vertically and horizontally aligned tab slot than the tab slot previously engaged, so as to effect non-parallel alignment of said track means with respect to the wall.

* * * * *